US007836859B2

(12) United States Patent
Iwata et al.

(10) Patent No.: US 7,836,859 B2
(45) Date of Patent: Nov. 23, 2010

(54) CHAIN COVER OF INTERNAL COMBUSTION ENGINE

(75) Inventors: Yasushi Iwata, Toyota (JP); Tatsuhiro Terada, Toyota (JP)

(73) Assignee: Toyota Jidosha Kabushiki Kaisha, Aichi-Ken (JP)

( * ) Notice: Subject to any disclaimer, the term of this patent is extended or adjusted under 35 U.S.C. 154(b) by 126 days.

(21) Appl. No.: 12/358,763

(22) Filed: Jan. 23, 2009

(65) Prior Publication Data

US 2009/0188465 A1 Jul. 30, 2009

(30) Foreign Application Priority Data

Jan. 25, 2008 (JP) ..... 2008-015378

(51) Int. Cl.
*F02B 77/00* (2006.01)

(52) U.S. Cl. ..... 123/90.38; 123/195 C

(58) Field of Classification Search ..... 123/90.38, 123/195 C, 198 E

See application file for complete search history.

(56) References Cited

U.S. PATENT DOCUMENTS 6,923,154 B2 * 8/2005 Gschwindt et al. ..... 123/195 C

FOREIGN PATENT DOCUMENTS

| | | | |
|---|---|---|---|
| JP | 8-200089 | A | 8/1996 |
| JP | 10-131734 | A | 5/1998 |
| JP | 10-220684 | A | 8/1998 |

OTHER PUBLICATIONS

Japanese Office Action for counterpart Japanese application, No. JP2008-015378, issued on Dec. 15, 2009 (with translation) (5 pages).

* cited by examiner

*Primary Examiner*—Noah Kamen
(74) *Attorney, Agent, or Firm*—Sughrue Mion, PLLC

(57) ABSTRACT

A first rib extending downward from a middle portion to an outer peripheral portion is formed on an inner wall of a chain cover. In addition a second rib, which extends downward from the outer peripheral portion to the middle portion and has a height lower than that of the first rib, is formed above the first rib. A projection extending in the height direction of the second rib is provided on an upper surface of the second rib.

3 Claims, 5 Drawing Sheets

CHAIN COVER OF INTERNAL COMBUSTION ENGINE

INCORPORATION BY REFERENCE

The disclosure of Japanese Patent Application No. 2008-015378 filed on Jan. 15, 2008, including the specification, drawings and abstract is incorporated herein by reference in its entirety.

BACKGROUND OF THE INVENTION

1. Field of the Invention

The invention relates to a chain cover that covers a timing chain for transmitting the rotation of a crankshaft of an internal combustion engine to a camshaft, the chain cover having reinforcing ribs on the inside thereof.

2. Description of the Related Art

An example of this type of chain cover is described in Japanese Patent Application Publication No. 10-220684 (JP-A-10-220684). This chain cover is provided with a first rib formed to extend downward from a middle portion to an outer peripheral portion of the chain cover, and a second rib formed to extend downward from an outer peripheral portion to a middle portion.

However, lubrication oil for lubricating a timing chain and lubrication oil and the like discharged from a hydraulic tensioner for adjusting the tension of the timing chain, are dispersed and adhere to the inner wall of the chain cover.

Lubrication oil that has adhered to the inner wall of the chain cover in this manner flows downward along the inner wall and when it reaches the first rib and the second rib, flows onto the upper surfaces of each of these ribs. Here, lubrication oil that has reached the first rib formed to extend downward from a middle portion to an outer peripheral portion flows in the direction of the outer peripheral portion of the chain cover due to the first rib, while lubrication oil that has reached the second rib formed to extend downward from an outer peripheral portion to a middle portion flows in the direction of the middle portion of the chain cover due to the second rib.

In this manner, lubrication that has flown in the direction from the middle portion to the outer peripheral portion of the chain cover subsequently returns to an oil pan without contacting the timing chain even it drops below the chain cover.

On the other hands lubrication oil that has flown from the outer peripheral portion to the middle portion of the chain cover drops downward from the middle portion of the chain cover, and ends up contacting the timing chain rotating around a crankshaft. In this manner, if the lubrication oil contacts the timing chain while it is rotating, air bubbles easily enter the lubrication oil, thereby leading to, for example, a decrease in hydraulic pressure of the lubrication system or an inadequate supply of lubrication oil.

SUMMARY OF THE INVENTION

This invention provides a chain cover of an internal combustion engine capable of allowing lubrication oil that has adhered to the inner wall of the chain cover to preferably flow from a middle portion of the chain cover toward the direction of an outer peripheral portion thereof.

A first aspect of the invention relates to a chain cover that covers a timing chain for transmitting the rotation of a crankshaft of an internal combustion engine to a camshaft, the chain cover having reinforcing ribs formed on the inner wall thereof The reinforcing ribs include a first rib formed to extend downward from a middle portion to an outer peripheral portion of the chain cover, and a second rib formed to extend downward from the outer peripheral portion to the middle portion of the chain cover, and together with forming the second rib above the first rib, the height of the second rib is lower than the height of the first rib.

According to this constitution, when lubrication oil flowing along the second rib formed to extend downward from the outer peripheral portion to the middle portion of the chain cover drops downward from the upper surface of the second rib, it is caught by the first rib and flows in the direction of the outer peripheral portion of the chain cover. Thus, lubrication oil adhered to the inner wall of the chain cover is able to be allowed to flow from the middle portion to the outer peripheral portion of the chain cover A projection extending in the height direction of the second rib may be provided on the upper surface of the second rib.

According to this constitution, the flow of lubrication oil on the upper surface of the second rib flowing in the direction of the middle portion of the chain cover is blocked by this projection, and the lubrication oil that has been blocked in this manner drops toward the first rib from the tipper surface of the second rib. Thus, lubrication oil flowing along the second rib is allowed to more reliably drop onto the first rib.

Moreover, the projection may be provided at end portion of the second rib at a site where the height of the second rib is lower than the first rib on the side of the middle portion of the chain cover.

According to this constitution, the majority of lubrication oil flowing over the upper surface of a site on the second rib having a height lower than the first rib can be blocked by this projection.

BRIEF DESCRIPTION OF THE DRAWINGS

The foregoing and further objects, features and advantages of the invention will become apparent from the following description of exemplary embodiments with reference to the accompanying drawings, wherein like numerals are used to represent like elements and wherein.

DETAILED DESCRIPTION OF EMBODIMENTS

Figure 1:
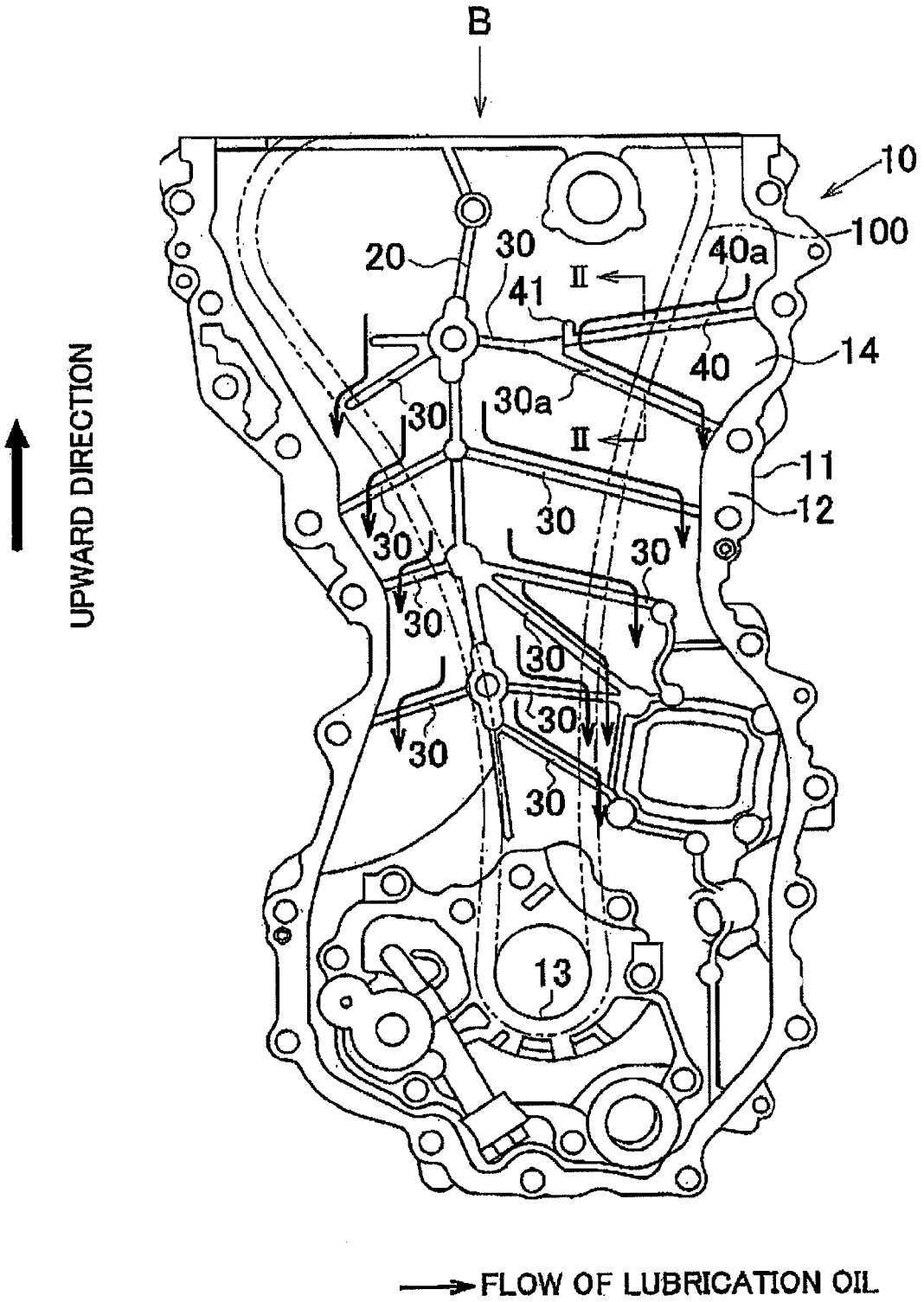
FIG. 1 is a front view of an embodiment of a chain cover to which is applied the chain cover of an internal combustion engine.
Figure 2:
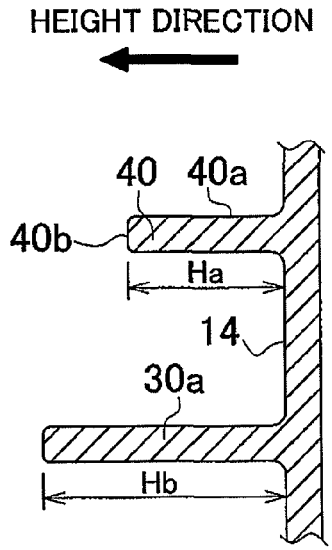
FIG. 2 is a cross-sectional view taken along line II-II of FIG. 1.
Figure 3:
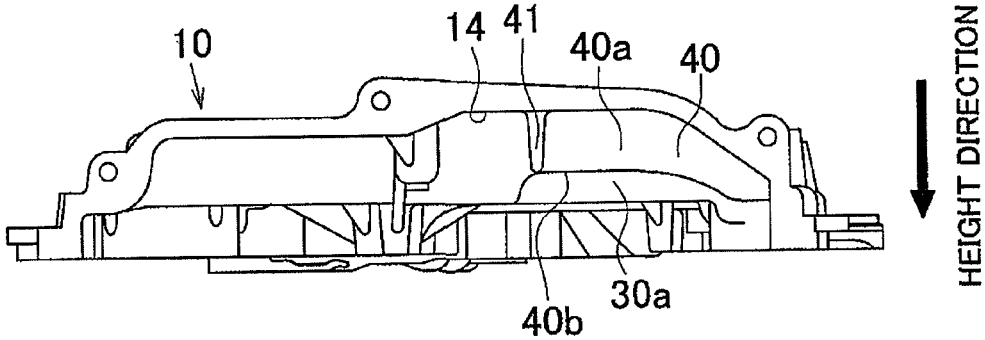
FIG. 3 is an overhead view of the chain cover of the same embodiment as viewed from the direction indicated with arrow B of FIG. 1.

The following provides an explanation of an embodiment of a chain cover of an internal combustion engine with reference to FIGS. 1 to 3. Furthermore, the upward and downward directions used in the subsequent explanation refer to the directions when the chain cover has been installed in an internal combustion engine.

FIG. 1 shows a front view of a chain cover 10 of the embodiment as viewed from the inside. This chain cover 10 is a cover for covering a timing chain 100 (indicated with double-dot broken lines in the drawings) that transmits rotation of a crankshaft of the internal combustion engine to a camshaft, and is fixed to an engine block so that the inside thereof opposes a lateral surface of the engine block. Furthermore, as is commonly known, the timing chain 100 is lubricated with engine lubrication oil, while the tension of the timing chain 100 is adjusted with a hydraulic tensioner.

A joining surface 12 contacted by the engine block is formed on an outer peripheral portion 11 of the chain cover 10, and an insertion hole 13 into which the crankshaft is inserted is formed in a lower middle portion thereof. A plurality of reinforcing ribs for ensuring rigidity of the chain cover 10 are formed on an inner wall 14 of the chain cover 10.

First, the middle portion of the chain cover 10 is formed with a longitudinal rib 20 extending downward from the top thereof. A plurality of first ribs 30 inclined downward from the middle portion to the outer peripheral portion 11 of the chain cover 10 are formed at prescribed intervals downward from the top of the chain cover 10 between the outer peripheral portion 11 of the chain cover 10 and the longitudinal rib 20.

Moreover, a second rib 40 is formed inclined downward from the outer peripheral portion 11 to the middle portion of the chain cover 10 above a first rib 30*a*. The first rib 30*a* is one of the first ribs 30, and is provided near the top of the chain cover 10 (upper right rib shown in FIG. 1). An end portion of this second rib 40 on the side of the middle portion of the chain cover 10 is connected to a site of the first rib 30*a* closer to the middle portion of the chain cover 10.

FIG. 2 shows a cross-sectional view taken along line II-II of FIG. 1, while FIG. 3 shows an overhead view of the chain cover 10. As shown in FIG. 2, a height Ha of the second rib 40 protruding from the inner wall 14 of the chain cover 10 is lower than a height Hb of the first rib 30*a*, and a site where the height is lower in this manner is formed over the entirety of the second rib 40 (see FIG. 3).

In addition, as shown in FIGS. 1 and 3, a projection 41 extending in the height direction (direction of height Ha in FIG. 2) of the second rib 40 is provided on an upper surface 40*a* of the second rib 40 at a site where the second rib 40 and the first rib 30*a* are connected. This projection 41 extends from the inner wall 14 to a top surface 40*b* in the height direction Ha of the second rib 40.

The following provides an explanation of the action of the chain cover 10 having the constitution as described above. When lubrication oil lubricating the timing chain 100 and lubrication oil discharged from the hydraulic tensioner and the like are dispersed and adhere to the inner wall 14 of the chain cover 10, the adhered lubrication oil flows downward along the inner wall 14 as shown in FIG. 1. When that lubrication oil reaches the first rib 30 and the second rib 40, it flows onto the upper surfaces of each rib.

Lubrication oil that has reached the first rib 30 formed to extend downward from the middle portion to the outer peripheral portion 11 flows in the direction of the outer peripheral portion of the chain cover 10 by flowing over the upper surface of the first rib 30. On the other hand, lubrication oil that has reached the second rib 40 formed to extend downward from the outer peripheral portion 11 to the middle portion flows in the direction of the middle portion of the chain cover 10 by flowing over the upper surface of the second rib 40. Here, the second rib 40 is formed above the first rib 30*a*, and the height of the second rib 40 is lower than the height of the first rib 30*a*. Consequently, as is shown in FIGS. 1 to 3, when lubrication oil flowing along the second rib 40 drops from the upper surface 40*a*, it is caught by the first rib 30*a* after which it flows over the tipper surface of the first rib 30*a* in the direction of the outer peripheral portion of the chain cover 10.

In addition, because the projection 41 is provided on the upper surface 40*a* of the second rib 40, the flow of lubrication oil over the upper surface 40*a* of the second rib 40 and in the direction of the middle portion of the chain cover 10 is blocked by the projection 41. At that time, because the projection 41 is provided at a site where the second rib 40 and the first rib 30*a* are connected, in other words, at an end portion of the second rib 40 having a height lower than the height of the first rib 30*a* on the side of the middle portion of the chain cover 10, the majority of lubrication oil flowing over the upper surface 40*a* of the second rib 40 is blocked by the projection 41. Lubrication oil blocked by this projection 41 drops down from the upper surface 40*a* in the vicinity of the projection 41 to the first rib 30*a*. As a result of forming the projection 41 in this manner, lubrication oil flowing along the second rib 40 is allowed to more reliably drop onto the first rib 30*a*.

In this manner, in the chain cover 10 of this embodiment, even if a rib is formed to extend downward from the outer peripheral portion 11 to a middle portion, the majority of lubrication oil adhered to the inner wall 14 of the chain cover 10 flows in tile direction of the outer peripheral portion from the middle portion of the chain cover 10. Consequently, the amount of lubrication oil adhered to the inner wall 14 that drops downward from the middle portion of the chain cover 10 decreases, and the amount of lubrication oil contacting the timing chain 100 decreases, thereby inhibiting the entry of air bubbles into the lubrication oil.

Incidentally, if a rib 40 formed to extend downward from the outer peripheral portion 11 to the middle portion is not provided, the amount of lubrication oil dropping from the middle portion of the chain cover 10 can be decreased. However, if a rib formed to extend downward from the outer peripheral portion 11 to the middle portion is not provided, limitations on the rib arrangement increase and the degree of freedom with respect to rib arrangement ends up decreasing. Consequently, it may be difficult to design the ribs to ensure rigidity of the chain cover 10. With respect to this point, as a result of this embodiment having the second rib 40 formed in the previously described shape, even if a rib formed to extend downward from the outer peripheral portion 11 to the middle portion is arranged, the amount of lubrication oil dropping from the middle portion of the chain cover 10 can be reduced, thereby making it possible to inhibit decreases in the degree of freedom of rib arrangement.

In addition, the height of the second rib 40 is lowered to serve as a structure for allowing lubrication oil adhered to the inner wall 14 of the chain cover 10 to flow from the middle portion of the chain cover 10 toward the direction of the outer peripheral portion thereof. As a result, lubrication oil can be allowed to flow from the middle portion of the chain cover 10 toward the direction of the outer peripheral portion thereof without significantly lowering the strength of the second rib 40 having the function of a reinforcing rib.

As has been explained above effects as described below can be obtained according to this embodiment.

(1) In addition to forming the second rib 40 formed to extend downward from the outer peripheral portion 11 of the chain cover 10 to the middle portion thereof above the first rib 30*a* formed to extend downward from the middle portion of the chain cover 10 to the outer peripheral portion 11, a site is provided on the second rib 40 that is lower than the height of the first rib 30*a*. Consequently, when lubrication oil flowing along the second rib 40 drops downward from the upper surface 40*a* of the second rib 40, it is caught by the first rib 30*a* and flows in the direction of the outer peripheral portion of the chain cover 10. Thus, lubrication oil adhered to the inner wall of the chain cover can be allowed to preferably flow from the middle portion of the chain cover toward the direction of the outer peripheral portion thereof.

(2) The projection 41 extending in the height direction Ha of the second rib 40 is provided on the upper surface of 40*a* of the second rib 40. Consequently, lubrication oil flowing along the second rib 40 is able to more reliably drop onto the first rib 30*a*.

(3) The projection 41 is provided at an end portion of the second rib 40 at a site lower than the height of the first rib 30*a* on the side of the middle portion of the chain cover 10. Consequently, the majority of lubrication oil flowing over the upper surface 40*a* of the second rib 40 is able to be blocked by the projection 41.

Furthermore, a variation of this embodiment can also be carried out as described below.

Figure 4:
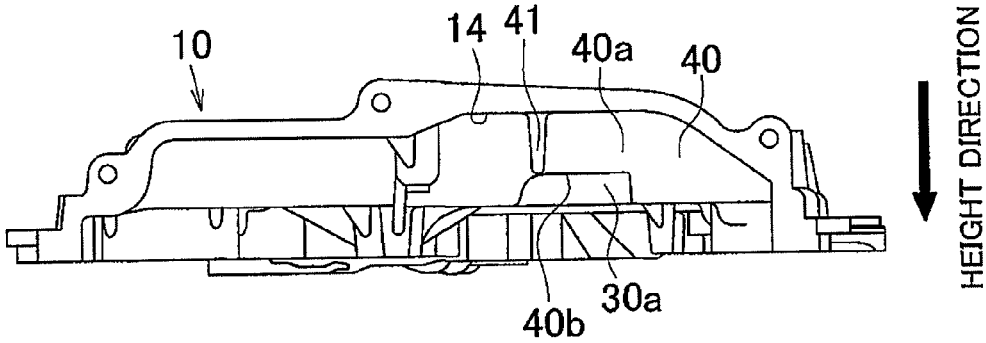
FIG. 4 is an overhead view of a chain cover in which is applied a second rib in a first variation of the same embodiment.

Although the height of the second rib 40 over the entirety thereof is made to be lower than the first rib 30*a*, as shown in FIG. 4, the only the height of a portion of the second rib 40 may be made to be lower.

Figure 5:
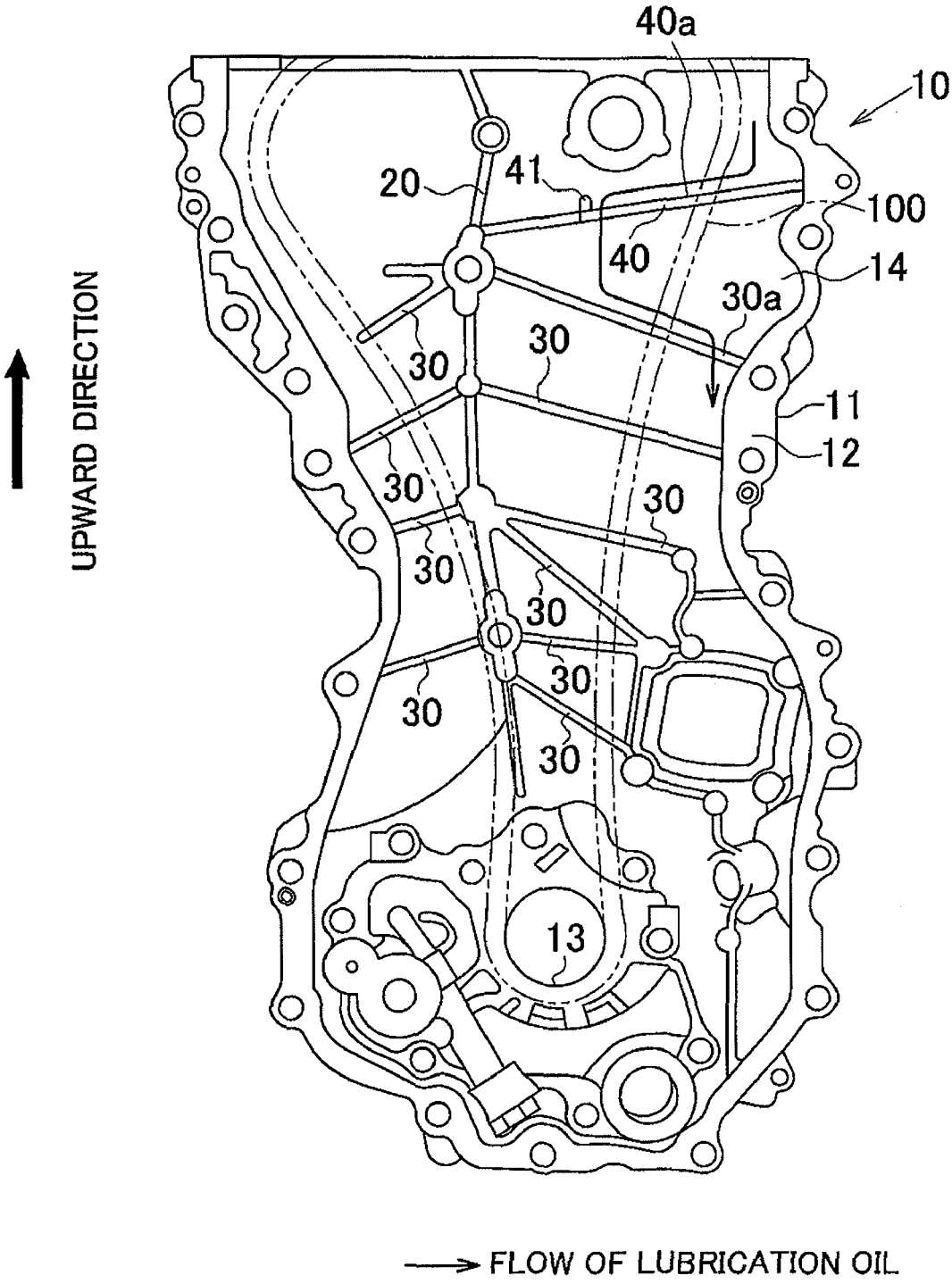
FIG. 5 is a front view of a chain cover in which is applied a second rib in a second variation of the same embodiment.

Although the end portion of the second rib 40 was made to connect with a site of the first rib 30*a* closer to the middle portion of the chain cover 10, the end portion of the second rib 40 may also be connected to another site thereof. For example, the end portion of the second rib 40 may be connected to the longitudinal rib 20 as shown in FIG. 5.

Figure 6:
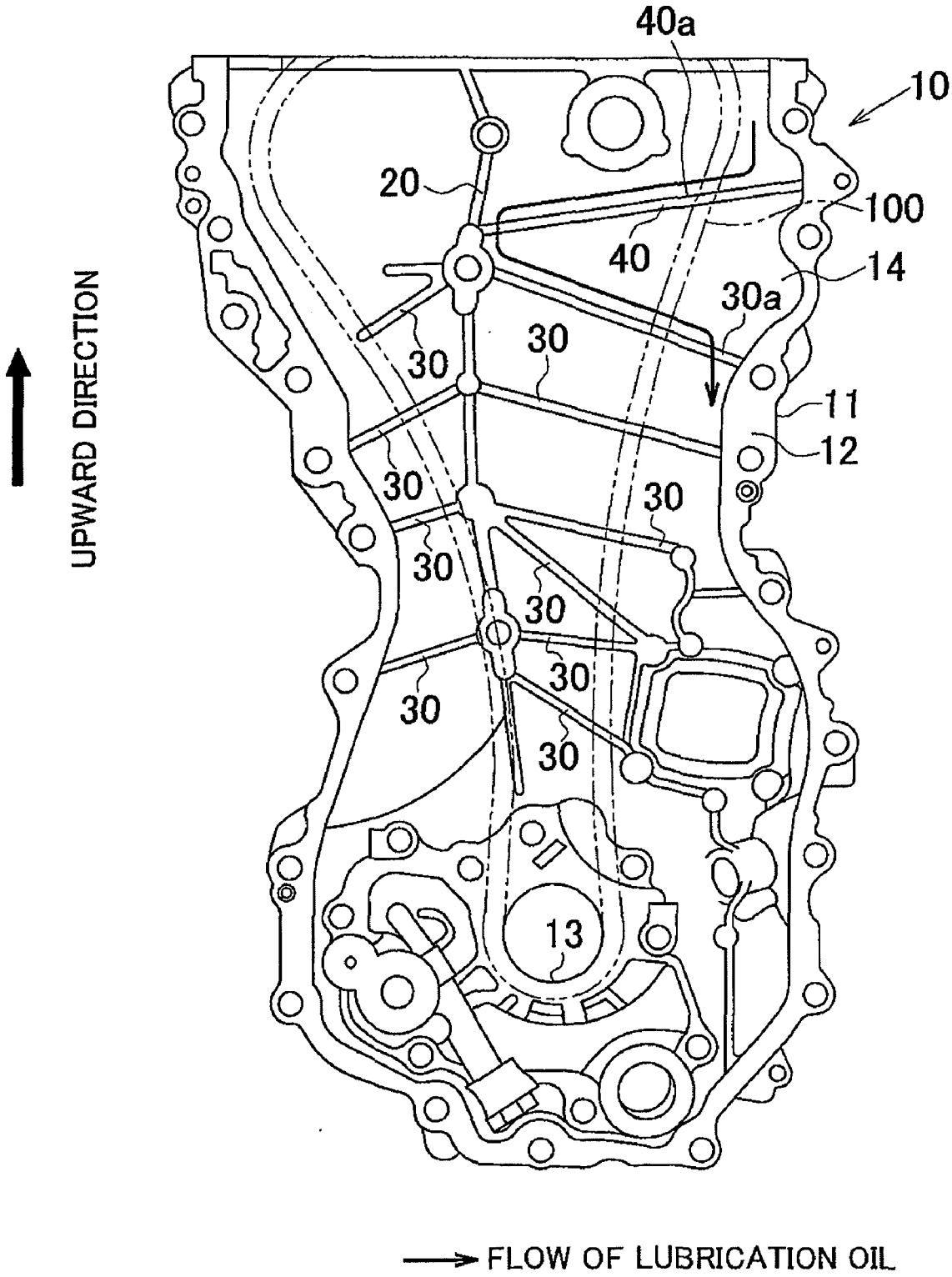
FIG. 6 is a front view of a chain cover in which is applied a second rib in a third variation of the same embodiment.

Furthermore, the projection 41 can be omitted as shown in FIG. 6 in the case of connecting the end portion of the second rib 40 to the longitudinal rib 20 and making the height of the second rib 40 over the entirety thereof lower than the first rib 30*a*. In this case, when lubrication oil flowing along the second rib 40 reaches the longitudinal rib 20, it drops downward from that point and is caught by the first rib 30*a*. This is because advantageous effects corresponding to the projection 41 are demonstrated by the longitudinal rib 20 in this manner.

Figure 7:
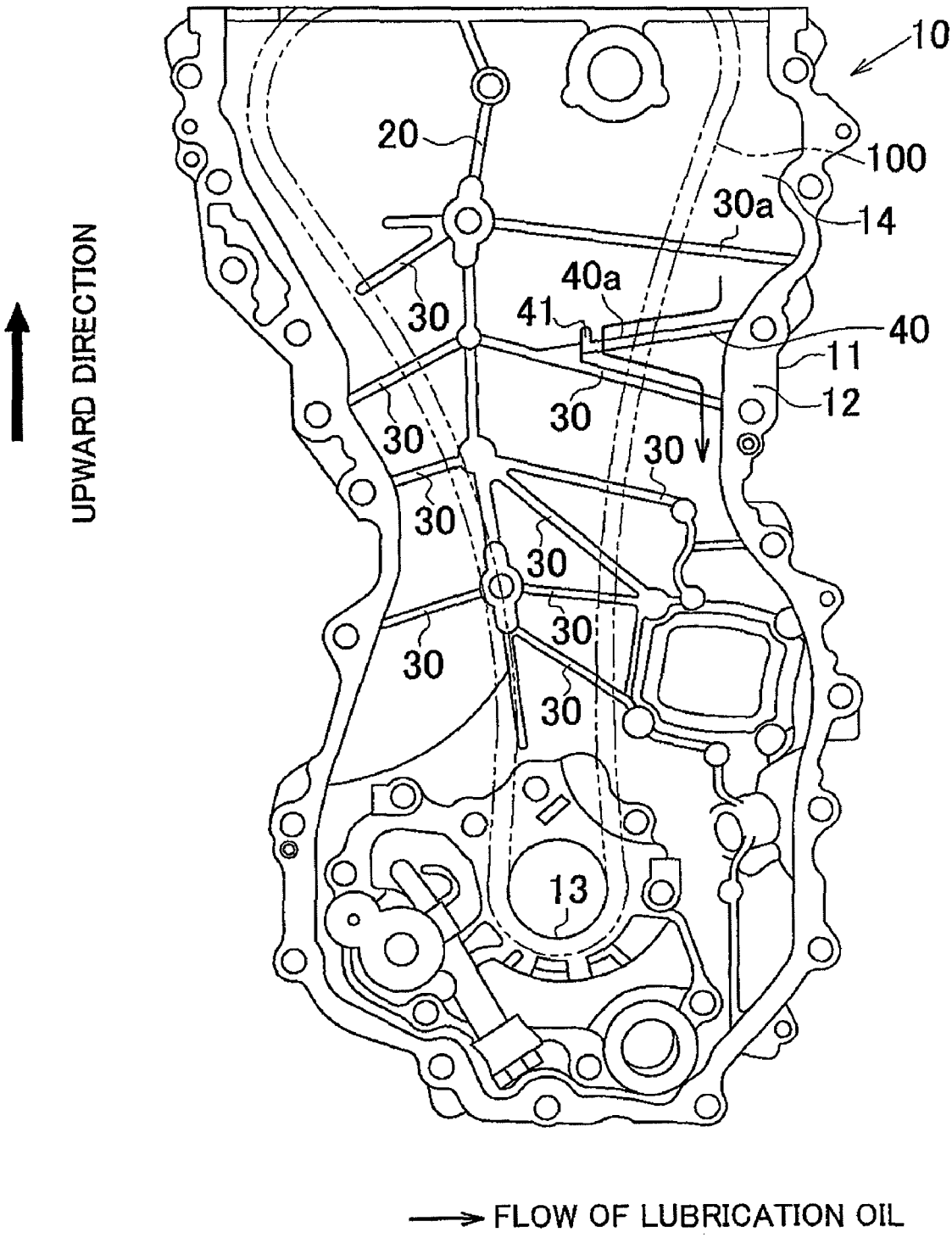
FIG. 7 is a front view of a chain cover in which is applied a second rib in a fourth variation of the same embodiment.

Although the second rib 40 was made to be provided above one of the first ribs 30 provided in the chain cover 10 in the form of the first rib 30*a*, as shown in FIG. 7, the second rib 40 may also be formed above another first rib 30.

Although the projection 41 was made to extend from the inner wall 14 of the chain cover 10 to the top surface 40*b* in the height direction of the second rib 40, the length thereof may be suitably changed.

The location where the projection 41 is arranged may be suitably changed provided it is located on the upper surface 40*a* of the second rib 40. In this case as wells lubrication oil flowing over the upper surface 40*a* of the second rib 40 between the projection 41 and the outer peripheral portion 11 is able to be allowed to drop onto the first rib which is provided directly below the second rib 40, and over which lubrication oil flows to the outer peripheral portion.

The projection 41 may also be omitted. In this case as well, action and effects as described in (1) above can be obtained.

What is claimed is:

1. A chain cover that covers a timing chain for transmitting the rotation of a crankshaft of an internal combustion engine to a camshaft, comprising:

reinforcing ribs formed on an inner wall of the chain cover, wherein the reinforcing ribs include a first rib formed to extend downward from a middle portion to an outer peripheral portion of the chain cover; and a second rib formed to extend downward from the outer peripheral portion to the middle portion of the chain cover, the second rib is formed above the first rib, and the height of the second rib is lower than the height of the first rib; and an end portion of the second rib on the side of the middle portion of the chain cover is connected to a site of the first rib, which is close to the middle portion of the chain cover.

2. The chain cover according to claim 1, wherein a projection extending in an upper direction of the second rib is provided on an upper surface of the second rib.

3. The chain cover according to claim 2, wherein the projection is provided at an end portion of the second rib at a site where the height of the second rib is lower than the height of the first rib, the end portion of the second rib being on the side of the middle portion of the chain cover.

* * * * *